US010706808B2

(12) United States Patent
Nagasaka et al.

(10) Patent No.: US 10,706,808 B2
(45) Date of Patent: Jul. 7, 2020

(54) DISPLAY DEVICE

(71) Applicant: SHARP KABUSHIKI KAISHA, Sakai, Osaka (JP)

(72) Inventors: Kohji Nagasaka, Sakai (JP); Takashi Sasaki, Sakai (JP); Tatsuya Nakamoto, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/333,940

(22) PCT Filed: Sep. 20, 2017

(86) PCT No.: PCT/JP2017/033855
§ 371 (c)(1),
(2) Date: Mar. 15, 2019

(87) PCT Pub. No.: WO2018/061917
PCT Pub. Date: Apr. 5, 2018

(65) Prior Publication Data

US 2019/0206358 A1 Jul. 4, 2019

(30) Foreign Application Priority Data

Sep. 27, 2016 (JP) ..... 2016-187848

(51) Int. Cl.
*G09G 3/36* (2006.01)
*G09G 3/20* (2006.01)

(52) U.S. Cl.
CPC ..... *G09G 3/3696* (2013.01); *G09G 3/20* (2013.01); *G09G 3/36* (2013.01); *G09G 3/3674* (2013.01);
(Continued)

(58) Field of Classification Search
CPC ..... G09G 3/20; G09G 3/36; G09G 3/3674; G09G 3/3688; G09G 3/3696; G09G 2300/0876; G09G 2320/0223
See application file for complete search history.

(56) References Cited

U.S. PATENT DOCUMENTS 6,232,941 B1 * 5/2001 Ode ..... G09G 3/2011 345/95
7,499,016 B2 * 3/2009 Oh ..... G09G 3/3413 345/102
(Continued)

FOREIGN PATENT DOCUMENTS

JP 2003-216114 A 7/2003
JP 2010-122652 A 6/2010
JP 2016-057433 A 4/2016

*Primary Examiner* — Joe H Cheng
(74) *Attorney, Agent, or Firm* — ScienBiziP, P.C.

(57) ABSTRACT

Provided is a video signal line driver circuit capable of displaying a video with a high viewing quality even when gradation voltages of the same value are simultaneously selected as analog video signals.
A voltage ladder 87 of a source driver 50 has formed therein gradation voltage supplement lines 91 extending to the outside of the source driver 50 from output terminals for outputting generated gradation voltages. The gradation voltage supplement lines 91 are grounded outside the source driver 50 via voltage supplement capacitors 90. Accordingly, even when gradation voltages of the same value are simultaneously selected as analog video signals, the voltage supplement capacitors 90 provide necessary current supplement to the voltage ladder 87, thereby inhibiting potential drop across the output terminals for outputting gradation voltages.

4 Claims, 10 Drawing Sheets

(52) U.S. Cl.
CPC ..... *G09G 2300/0876* (2013.01); *G09G 2320/0223* (2013.01)

(56) References Cited

U.S. PATENT DOCUMENTS

| | | | | |
|---|---|---|---|---|
| 2003/0137479 | A1 | 7/2003 | Yamasaki | |
| 2005/0024315 | A1* | 2/2005 | Yamagata | G09G 3/2011 345/98 |
| 2006/0001627 | A1* | 1/2006 | Murata | G09G 3/2011 345/89 |
| 2006/0114219 | A1* | 6/2006 | Park | G09G 3/3413 345/102 |
| 2007/0171163 | A1* | 7/2007 | Miyata | G09G 3/3614 345/87 |
| 2008/0211835 | A1* | 9/2008 | Enjou | G09G 3/3685 345/690 |
| 2009/0009537 | A1* | 1/2009 | Shimatani | G09G 3/3688 345/690 |
| 2009/0189924 | A1* | 7/2009 | Ogura | G09G 3/3233 345/690 |
| 2010/0123653 | A1 | 5/2010 | Kwon et al. | |
| 2010/0123738 | A1* | 5/2010 | Matsukawa | G09G 3/3648 345/690 |
| 2016/0071479 | A1 | 3/2016 | Shiibayashi et al. | |
| 2017/0011702 | A1* | 1/2017 | Yamagishi | G09G 3/3685 |

* cited by examiner

DISPLAY DEVICE

TECHNICAL FIELD

The present invention relates to display devices, particularly to an active-matrix display device that provides gradation display. This application is a national stage of PCT/JP2017/033855, filed on Sep. 20, 2017, which claims priority to Japanese Application No. 2016-187848, filed on Sep. 27, 2016.

BACKGROUND ART

Display devices, such as liquid crystal display devices, include video signal line driver circuits (also referred to as "source drivers") for generating gradation voltages on the basis of gradation reference voltages, selecting voltages from the generated gradation voltages in accordance with video signals, and applying the selected voltages to video signal lines (also referred to as "source lines") as analog video signals, and such display devices also include scanning signal line driver circuits (also referred to as "gate drivers") for sequentially applying high-level scanning signals to scanning signal lines (also referred to as "gate lines") in order to sequentially activate the gate lines and thereby write the analog video signals applied to the source lines in pixels.

In the case of such a display device, to generate analog video signals corresponding to externally inputted digital video signals, the source driver selects some gradation voltages, which are generated on the basis of gradation reference voltages by means of a voltage ladder provided as a gradation voltage generation circuit, and as the analog video signals, the source driver applies the gradation voltages to a plurality of source lines formed in a display panel. In this case, gradation voltages of the same value might be simultaneously selected for a number of source lines. In this manner, if such gradation voltages of the same value are simultaneously selected for a number of source lines, a higher current flow through resistive elements that should output the gradation voltages in the voltage ladder. As a result, due to voltage drop, the voltage ladder might output gradation voltages with values lower than values with which the gradation voltages should originally be outputted.

FIG. 9 is a diagram illustrating a video displayed on a display panel where, due to voltage drop, values of gradation voltages are lower than values with which the gradation voltages should originally be applied. As shown in FIG. 9, black areas 101 are displayed in upper left and upper right portions of a screen, and between these areas, there lies an area 102 displayed in white. Moreover, displayed across a lower portion of the screen is a white area 103. On such a screen, one horizontal line next to another horizontal line indicating the bottom of the black areas 101 should originally be displayed in white, but a black line 104 might be displayed, as shown in FIG. 9.

The reason why such a black line 104 is displayed will be described. FIG. 10 is a diagram illustrating the configuration of a conventional source driver 150 described in Patent Document 1. Analog video signals outputted by the source driver 150 are signals selected in accordance with an inputted video signal, from among gradation voltages derived from output terminals of a voltage ladder 87 provided in the source driver 150. Accordingly, when a video displayed on a horizontal line is changed from a combination of black and white to simply white, the voltage ladder 87 should simultaneously output simply a number of gradation voltages corresponding to the white video. In this case, of all gradation voltages outputted by the voltage ladder 87, the gradation voltages corresponding to the white video are selected a number of times. As a result, the current that is required for outputting such gradation voltages is limited, whereby the output voltage of the source driver 150 decreases, so that voltages with values lower than values that the voltages should originally have are applied to source lines. Therefore, on the display panel, the horizontal line that should originally be displayed in white is reduced in luminance, and the horizontal line with the reduced luminance is seen as a black line.

In particular, in the case of a display panel with a high-definition resolution called "4K" or "8K", the number of gate lines is very high, respectively approximately 2000 or approximately 4000, and therefore, the drive frequency of the source driver 150 is high. Accordingly, before the gradation voltages outputted by the voltage ladder 87 are recovered from reduced values to original values, the source driver 150 has to output gradation voltages for the next horizontal line, and therefore, the black line is more likely to be seen.

Patent Document 1 discloses a display device including the source driver which, as shown in FIG. 10, is provided with charge supplement circuits 58 for providing charge supplement to respective gradation voltage lines 98 through which gradation voltages generated by the voltage ladder 87 are outputted, whereby even when voltage drop occurs to the gradation voltage lines 98 due to, for example, the timing of switching video data, the gradation voltages can be stably outputted by promptly recovering the gradation voltages to original values.

CITATION LIST

Patent Document

Patent Document 1: Japanese Laid-Open Patent Publication No. 2016-57433

SUMMARY OF THE INVENTION

Problems to be Solved by the Invention

However, the charge supplement circuit 58 described in Patent Document 1 consists of two transistors and one capacitor. When such a charge supplement circuit 58 is provided for each output line of the voltage ladder 87, the source driver 150 is increased in circuit scale, resulting in an increased production cost thereof. Moreover, the speed at which the gradation voltage lines 98 are recovered from reduced voltages is determined by a response speed of the transistors. Accordingly, as the source driver 150 is increased in circuit scale, the response speed slows down, with the result that voltage recovery slows down as well. Thus, video display on the display device is reduced in visual quality.

Furthermore, it is conceivable to provide a capacitor for each gradation voltage line 98 of the voltage ladder 87. However, when such capacitors are provided in a semiconductor chip in which the source driver 150 is formed, each capacitor that can be formed cannot have a large capacity and can only have a capacity of approximately 1 pF at most. Providing a capacitor with such a small capacity for each gradation voltage line 98 is not expected to have much effect on inhibiting analog video signals from suffering from voltage drop. Note that FIG. 10 depicts a control board 120 and a source board 130, along with circuits, devices, and other elements mounted on these boards. However, such elements are also depicted in FIG. 4 to be described later and therefore will be described in detail in conjunction with FIG. 4.

Therefore, an objective of the present invention is to provide a video signal line driver circuit capable of displaying a video with a high visual quality even when gradation voltages of the same value are simultaneously selected as analog video signals.

Solution to the Problems

A first aspect of the present invention is directed to an active-matrix display device for providing gradation display of a video to be displayed, including:

a display panel including a plurality of scanning signal lines, a plurality of video signal lines crossing the scanning signal lines, and a plurality of display elements disposed in a matrix corresponding to respective intersections of the scanning signal lines and the video signal lines;

a scanning signal line driver circuit configured to selectively activate the scanning signal lines;

a gradation reference voltage generation circuit configured to output gradation reference voltages; and a video signal line driver circuit including a gradation voltage generation portion configured to generate gradation voltages based on the gradation reference voltages outputted by the gradation reference voltage generation circuit and a selector portion configured to select one of the gradation voltages based on an externally provided video signal, thereby generating an analog video signal, and apply the analog video signal to the video signal line, wherein, the gradation voltage generation portion includes first voltage lines extending from output terminals for outputting the generated gradation voltages, the first voltage lines being grounded outside the video signal line driver circuit via first capacitors.

In a second aspect of the present invention, based on the first aspect of the present invention, wherein the gradation voltage generation portion includes a voltage ladder including a plurality of resistive elements connected in series, and the gradation voltage is a voltage obtained by subjecting a voltage derived from the gradation reference voltage generation circuit to resistive division by the resistive elements.

In a third aspect of the present invention, based on the first aspect of the present invention, wherein the first capacitor has a capacity of 5 to 15 μF.

In a fourth aspect of the present invention, based on the third aspect of the present invention, wherein the number of first capacitors is six to 13.

In a fifth aspect of the present invention, based on the second aspect of the present invention, wherein the gradation reference voltage generation circuit, provides the gradation reference voltages to terminals of resistive elements situated at opposite ends of the resistive elements connected in series in the voltage ladder and also to predetermined connection nodes between all the connection nodes of the resistive elements in series in the voltage ladder.

In a sixth aspect of the present invention, based on the fifth aspect of the present invention, wherein the gradation reference voltage generation circuit provides the gradation reference voltages to terminals of resistive elements situated at opposite ends of the resistive elements connected in series in the voltage ladder and also to predetermined connection nodes of all the connection nodes of the resistive elements.

Effect of the Invention

In the first aspect of the invention, the gradation voltage generation portion of the video signal line driver circuit has formed thereon first voltage lines extending to the outside of the video signal line driver circuit from output terminals for outputting generated gradation voltages. The first voltage lines are grounded outside the video signal line driver circuit via the first capacitors. Accordingly, even when gradation voltages of the same value are simultaneously selected as analog video signals, the first capacitors provide necessary current supplement to the gradation voltage generation portion, thereby inhibiting potential drop across the output terminals for outputting the gradation voltages. Thus, the display device can display a video with a high viewing quality. Moreover, since the first capacitors are provided outside the video signal line driver circuit, the video signal line driver circuit can be kept from being increased in circuit scale.

In the second aspect of the invention, the gradation voltages are obtained through resistive division of voltages derived from the reference voltage generation circuit, by means of the resistive elements connected in series in the voltage ladder. Thus, the gradation voltages can be readily and reliably obtained.

In the third aspect of the invention, each first capacitor has a capacity of 5 to 15 μF, and therefore, even when gradation voltages of the same value are simultaneously selected as analog video signals, the first capacitors can provide necessary current supplement to the gradation voltage generation portion. Thus, it is possible to inhibit potential drop across the output terminals for outputting the gradation voltages.

In the fourth aspect of the invention, the number of first capacitors connected to the first voltage line is six to 13, and therefore, even when gradation voltages of the same value are simultaneously selected as analog video signals, the first capacitors provide necessary current supplement to the gradation voltage generation portion. Thus, it is possible to inhibit potential drop across the output terminals for outputting the gradation voltages.

In the fifth aspect of the invention, the reference voltage circuit applies gradation reference voltages not only to opposite ends of all resistive elements connected in series in the voltage ladder but also to predetermined connection nodes. Thus, the gradation voltages can be set more accurately.

In the sixth aspect of the invention, the second lines connecting the reference voltage generation circuit and the connection nodes are connected to the grounded second capacitors. Thus, providing current supplement by the second capacitors inhibits the potential across the connection nodes from fluctuating. Moreover, the second capacitors are provided outside the video signal line driver circuit, and therefore, the video signal line driver circuit can be kept from being increased in circuit scale.

BRIEF DESCRIPTION OF THE DRAWINGS

FIG. 7(A) is a graph showing a waveform of an output voltage derived from a conventional source driver, on a horizontal line by horizontal line basis, and FIG. 7(B) is a graph showing a waveform of an output voltage derived from the source driver included in the embodiment, on a horizontal line by horizontal line basis.

MODES FOR CARRYING OUT THE INVENTION

1. Embodiment

<1.1 Configuration and Operation of the Display Device>

Figure 1:
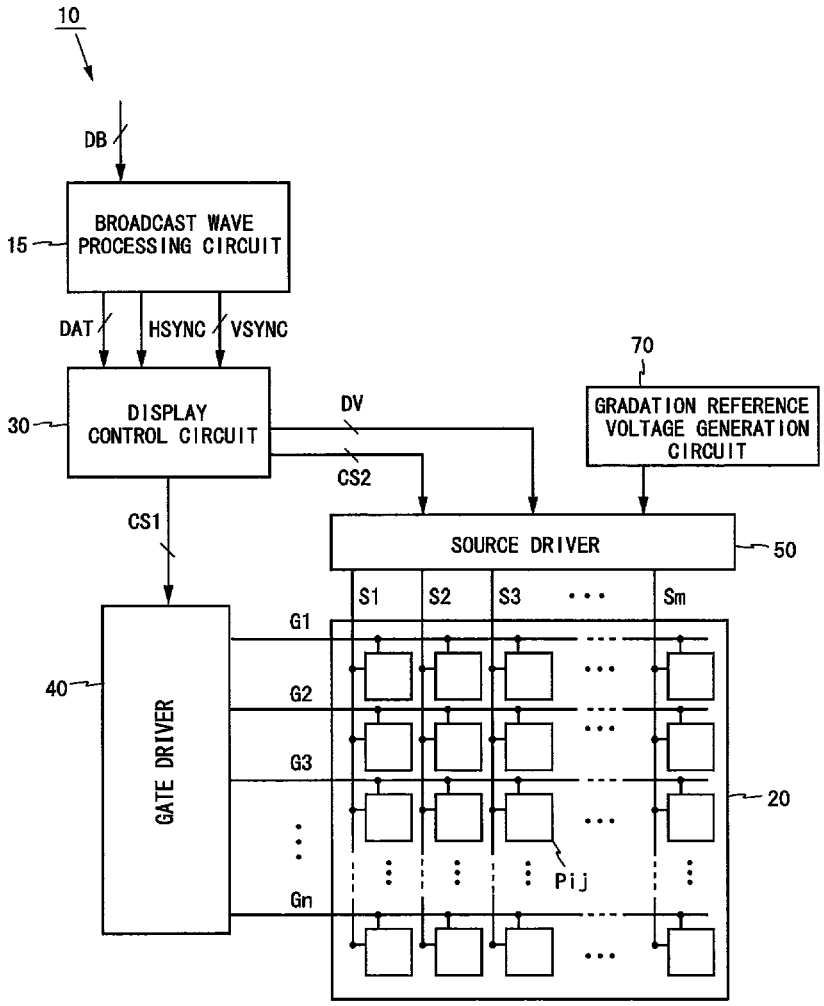
FIG. 1 is a block diagram illustrating the configuration of a liquid crystal display device according to an embodiment of the present invention.

FIG. 1 is a block diagram illustrating the configuration of a liquid crystal display device 10 according to an embodiment of the present invention. As shown in FIG. 1, the liquid crystal display device 10 includes a broadcast wave processing circuit 15, a liquid crystal panel 20, a display control circuit 30, gate drivers 40 (also referred to as "scanning signal line driver circuits"), source drivers 50 (also referred to as "video signal line driver circuits"), and a gradation reference voltage generation circuit 70.

The liquid crystal panel 20 includes n gate lines $G_1$ to $G_n$ (also referred to as "scanning signal lines"), m source lines $S_1$ to $S_m$ (also referred to as "video signal lines"), and (m×n) pixels $P_{ij}$ (m and n: integers of 2 or more, i: an integer of from 1 to n, j: an integer of from 1 to m). The gate lines $G_1$ to $G_n$ are disposed parallel to each other, and the source lines $S_1$ to $S_m$ are disposed parallel to each other so as to cross the gate lines $G_1$ to $G_n$. The pixel $P_{ij}$ (also referred to as the "display element") is disposed near an intersection of the i'th gate line $G_i$ and the j'th source line $S_j$. In this manner, the (m×n) pixels $P_{ij}$ are disposed in a matrix with m pixels in each row and n pixels in each column. The gate line $G_i$ is connected in common to the pixels $P_{ij}$ disposed in the i'th row, and the source line $S_j$ is connected in common to the pixels $P_{ij}$ disposed in the j'th column.

A broadcast wave DB is received by an antenna (not shown) and subjected to signal processing by the broadcast wave processing circuit 15, with the result that control signals, such as horizontal synchronization signals HSYNC and vertical synchronization signals VSYNC, and video signals DAT are generated. On the basis of the control signals and the video signals DAT generated by the broadcast wave processing circuit 15, the display control circuit 30 generates control signals CS1, control signals CS2, and digital video signals DV, and outputs the control signals CS1 to the gate drivers 40 and the control signals CS2 and the digital video signals DV to the source drivers 50.

In accordance with the control signals CS1, the gate drivers 40 sequentially provide high-level output signals to the gate lines $G_1$ to $G_n$ one by one. As a result, the gate lines $G_1$ to $G_n$ are sequentially selected one by one, thereby collectively selecting the pixels $P_{ij}$ in one row at a time. In accordance with the control signals CS2 and the digital video signals DV, the source drivers 50 generate analog video signals, which are analog signal voltages corresponding to the digital video signals DV, and provide the generated signals to the respective source lines $S_1$ to $S_m$. As a result, the analog video signals corresponding to the digital video signals DV are written in the selected pixels $P_{ij}$ in the respective rows. In this manner, a video corresponding to the video signals is displayed on the liquid crystal panel 20 of the liquid crystal display device 10.

<1.2 Liquid Crystal Panel and Various Boards Incorporated in the Liquid Crystal Display Device>

Figure 2:
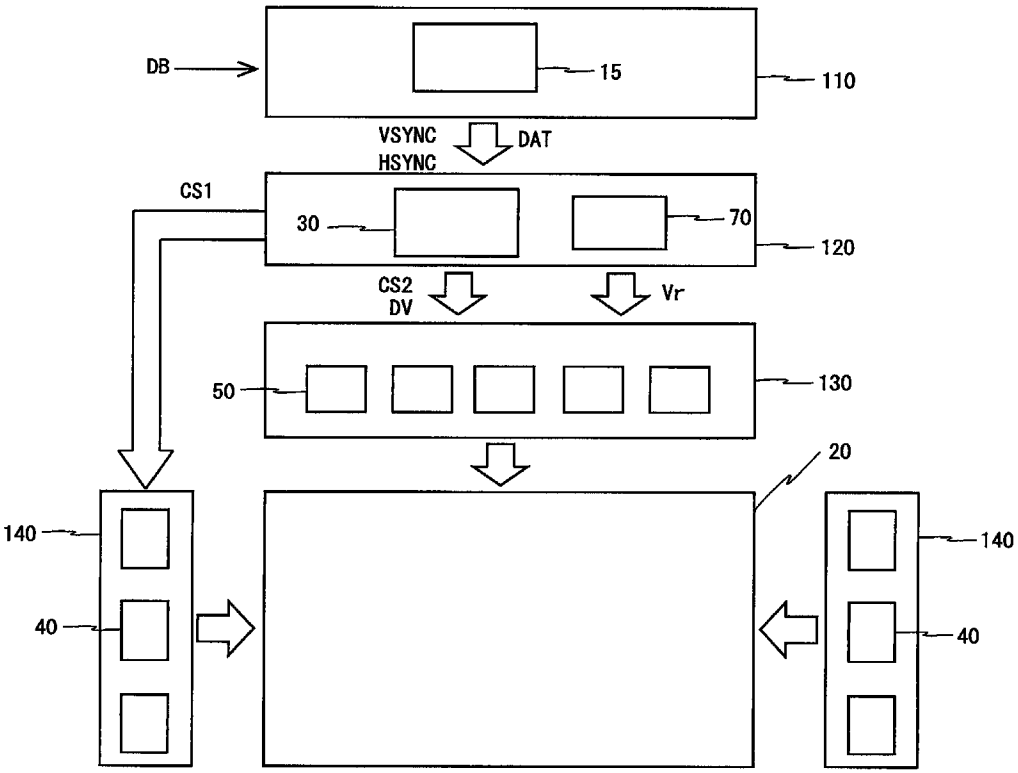
FIG. 2 is a diagram illustrating a liquid crystal panel and various boards incorporated in the liquid crystal display device shown in FIG. 1.

FIG. 2 is a diagram illustrating the liquid crystal panel 20 and various boards 110 to 140 incorporated in the liquid crystal display device 10 shown in FIG. 1. As shown in FIG. 2, the liquid crystal display device 10 includes the liquid crystal panel 20, as well as the main board 110, the control board 120, the source board 130, and the gate board 140, which are disposed around the liquid crystal panel 20.

The main board 110 has mounted thereon the broadcast wave processing circuit 15 for performing signal processing on a broadcast wave DB. The broadcast wave processing circuit 15 performs signal processing on a broadcast wave DB received by the antenna, thereby generating control signals, including horizontal synchronization signals HSYNC and vertical synchronization signals VSYNC, and video signals DAT. The generated video signals DAT and control signals, including the horizontal synchronization signals HSYNC and the vertical synchronization signals VSYNC, are provided to the display control circuit 30 mounted on the control board 120.

The control board 120 has mounted thereon the display control circuit 30 and the gradation reference voltage generation circuit 70. The display control circuit 30 is provided with the video signals DAT and the control signals, including the horizontal synchronization signals HSYNC and the vertical synchronization signals VSYNC, all of which are derived from the main board 110. In accordance with the video signals DAT and the control signals, including the horizontal synchronization signals HSYNC and the vertical synchronization signals VSYNC, the display control circuit 30 generates control signals CS1 for gate drivers 40, control signals CS2 for source drivers 50, and digital video signals DV, and outputs the control signals CS1 for gate drivers 40 to the gate drivers 40 mounted on the gate board 140, and the control signals CS2 for source drivers 50 and the digital video signals DV to the source drivers 50 mounted on the source board 130. The control signals CS1 for gate drivers 40 include gate start pulse signals GSP and gate clock signals GCK, and the source driver control signals CS2 include source start pulse signals SSP, source clock signals SCK, and latch strobe signals LS. Note that the gradation reference voltage generation circuit 70 will be described in detail later.

The gate drivers 40 mounted on the gate board 140 have output terminals respectively connected to the gate lines $G_1$ to $G_n$ formed in the liquid crystal panel 20. Accordingly, high-level scanning signals are provided sequentially to the respective gate lines $G_1$ to $G_n$, thereby sequentially activating the gate lines $G_1$ to $G_n$. Note that left and right terminals of each of the gate lines $G_1$ to $G_n$ are connected to respective output terminals of the gate drivers 40 that are disposed closely thereto, and therefore, the same scanning signals are simultaneously applied from left and right to each of the gate lines $G_1$ to $G_n$, as shown in FIG. 2. Thus, it is possible to prevent a delay of the scanning signals applied to the gate lines $G_1$ to $G_n$.

The source drivers 50 mounted on the source board 130 have output terminals respectively connected to the source lines $S_1$ to $S_m$ formed in the liquid crystal panel 20. The source drivers 50 select gradation voltages corresponding to video signals for the respective source lines, from among a plurality of gradation voltages, and simultaneously output the selected gradation voltages to the source lines as analog video signals. In this manner, the analog video signals applied to the source lines $S_1$ to $S_m$ are written in the pixels $P_{ij}$ connected to the gate lines $G_i$ to which the high-level voltage is being applied. Moreover, the source board has mounted thereon voltage supplement capacitors 90 for providing current supplement so as not to lower the gradation voltages, and the voltage supplement capacitors 90 will be described in detail later.

It should be noted that the number of gate drivers 40 mounted on the gate board 140 and the number of source drivers 50 mounted on the source board 130 are illustrative examples and are not limiting.

<4.2 Operation of the Source Driver>

Figure 3:
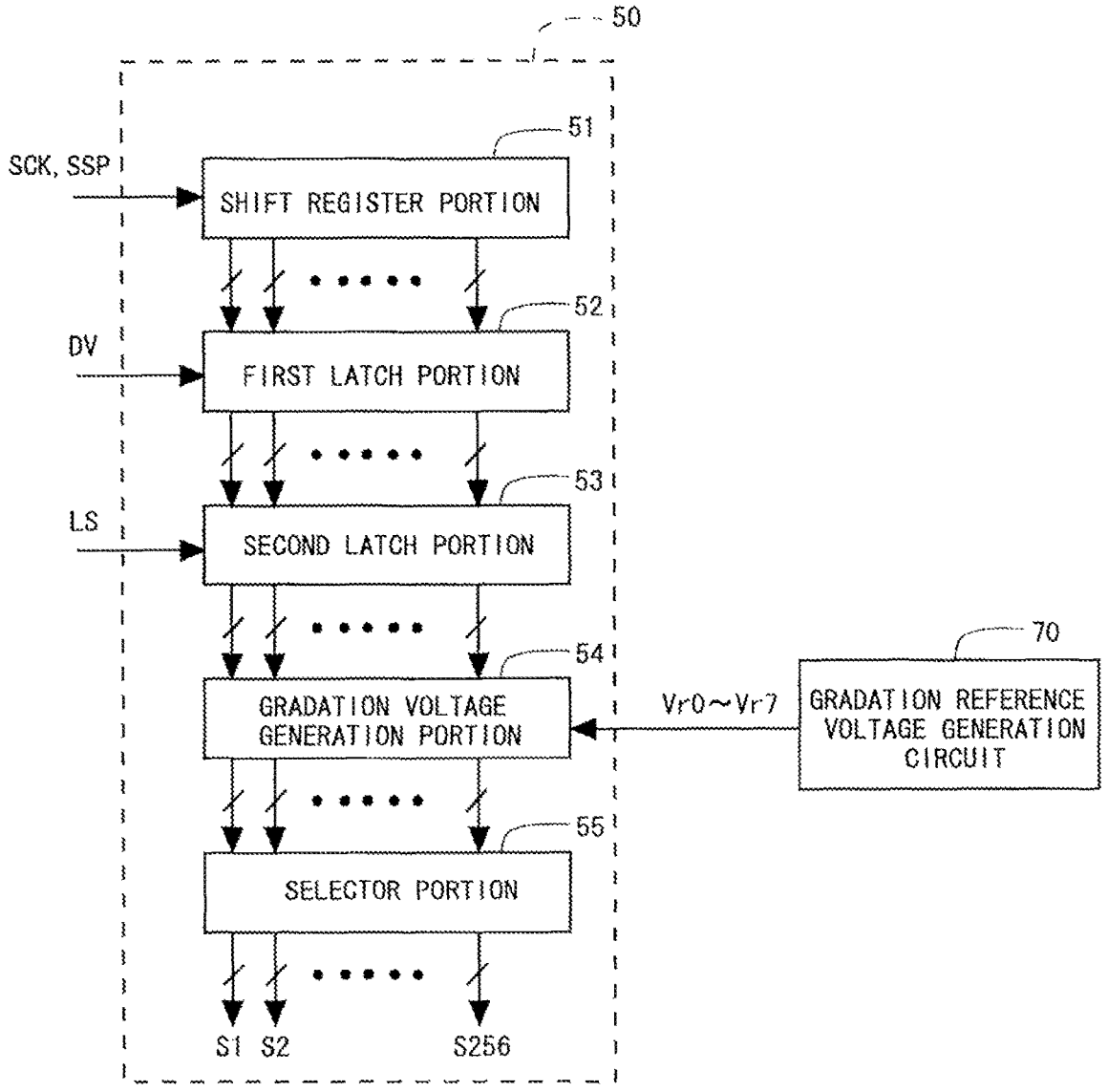
FIG. 3 is a block diagram illustrating the configuration of a source driver included in the liquid crystal display device shown in FIG. 1.

FIG. 3 is a block diagram illustrating the configuration of the source driver 50. The configuration of the source driver 50 will be described with reference to FIG. 3. The source driver 50 includes a shift register portion 51, a first latch portion 52, a second latch portion 53, a gradation voltage generation portion 54, and a selector portion 55.

The shift register portion 51 receives source start pulse signals SSP and source clock signals SCK, both of which are outputted by the display control circuit 30. In accordance with these signals SSP and SCK, the shift register portion 51 transfers pulses included in the source start pulse signals SSP sequentially from input to output terminals.

In response to the pulses inputted by the shift register portion 51, the first latch portion 52 samples and latches a digital video signal DV outputted by the display control circuit 30, and transfers the latched digital video signal DV to the second latch portion 53. Once the digital video signal DV for pixels in one horizontal line is memorized in the second latch portion 53, the display control circuit 30 provides a latch strobe signal LS to the second latch portion 53. When the second latch portion 53 receives the latch strobe signal LS, the second latch portion 53 outputs the digital video signal DV to the selector portion 55 for one horizontal scanning period. During this period, the shift register portion 51 and the first latch portion 52 sequentially memorize a digital video signal DV for the next horizontal line.

The gradation voltage generation portion 54 generates and outputs 256 gradation voltages $VH_0$ to $VH_{255}$ respectively corresponding to 256 gradation levels that can be represented by the 8-bit digital video signal DV outputted by the second latch portion 53. In the following description, the source driver 50 will be described as a source driver compatible with 256-gradation display, but this is an illustrative example, and the source driver 50 may be a source driver compatible with, for example, 1024-gradation display.

The selector portion 55 selects a gradation voltage VHk corresponding to the 8-bit digital video signal DV, from among the gradation voltages generated by the gradation voltage generation portion 54, and outputs the selected gradation voltage to each source line $S_k$ as an analog video signal.

<4.3 Configuration and Operation of the Gradation Voltage Generation Portion 54>

Figure 4:
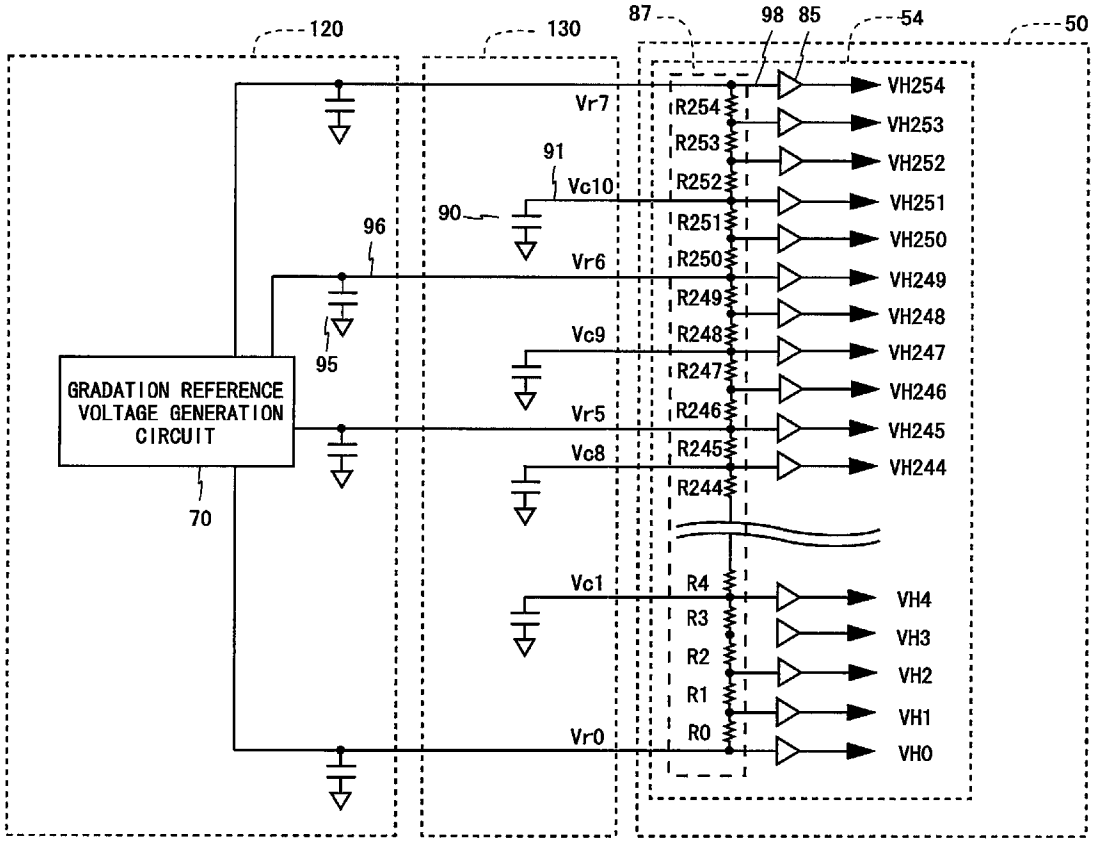
FIG. 4 is an equivalent circuit diagram of a gradation voltage generation portion included in the source driver shown in FIG. 3.

FIG. 4 is an equivalent circuit diagram of the gradation voltage generation portion 54. As shown in FIG. 4, the gradation voltage generation portion 54 includes a voltage ladder 87. The voltage ladder 87 is a circuit including 255 resistive elements $R_0$ to $R_{254}$ connected in series between a terminal to which a gradation reference voltage $Vr_0$ is applied and a terminal to which a gradation reference voltage $Vr_7$ is applied, these gradation reference voltages being outputted by the gradation reference voltage generation circuit 70 mounted on the control board 120; the voltage ladder 87 outputs voltages obtained through resistive division of the difference between the gradation reference voltages at both terminals, i.e., $(Vr_7-Vr_0)$, from 256 gradation voltage lines 98 connected to connection nodes between adjacent resistive elements. For example, the gradation voltage $VH_{100}$ at the connection node between the resistive elements $R_{99}$ and $R_{100}$ is obtained by the following equation (1):

$$VH_{100}=Vr_0+(Vr_7-Vr_0)\times(R_0+R_1+\ldots+R_{99})/(R_0+R_1+\ldots+R_{254}) \quad (1)$$

To set the gradation voltages more accurately, it is preferable to further provide approximately five to eight gradation reference voltages between the resistive elements $R_0$ and $R_{254}$. For example, in FIG. 4, the gradation reference voltage $Vr_6$ is provided to the connection node between the resistive element $R_{250}$ and the resistive element $R_{249}$, the gradation reference voltage $Vr_5$ to the connection node between the resistive element $R_{246}$ and the resistive element $R_{245}$, the gradation reference voltage $Vr_4$ to the connection node between the resistive element $R_{192}$ and the resistive element $R_{191}$, the gradation reference voltage $Vr_3$ to the connection node between the resistive element $R_{128}$ and the resistive element $R_{127}$, the gradation reference voltage $Vr_2$ to the connection node between the resistive element $R_{64}$ and the resistive element $R_{63}$, and the gradation reference voltage $Vr_1$ to the connection node between the resistive element $R_{32}$ and the resistive element $R_{31}$. These connection nodes and gradation reference voltages are illustrative examples and are not limiting.

Furthermore, to apply the gradation reference voltages $Vr_0$ to $Vr_7$ to the respective connection nodes of the voltage ladder 87, gradation reference voltage lines 96 are provided for the respective gradation reference voltages so as to connect the gradation reference voltage generation circuit 70 to the connection nodes. Each gradation reference voltage line 96 is provided with a gradation reference voltage capacitor 95 connected at one end to the gradation reference voltage line 96 and grounded at the other end.

The gradation reference voltage capacitors 95 are charged by the gradation reference voltages $Vr_0$ to $Vr_7$ outputted by the gradation reference voltage generation circuit 70. Accordingly, when the potential across the connection nodes connected to the gradation reference voltage lines 96 fluctuates, the gradation reference voltage capacitors 95 provide current supplement to the connection nodes, thereby maintaining constant potential across the connection nodes. Moreover, the output terminals respectively connected to the connection nodes between the resistive elements $R_0$ to $R_{254}$ are connected to the selector portion 55 via operational amplifiers 85 functioning as buffer circuits.

Further, in the present embodiment, gradation voltage supplement lines 91 are formed so as to be led to the source board 130 from predetermined connection nodes between the resistive elements $R_0$ and $R_{255}$, and the gradation voltage supplement lines 91 are grounded on the source board 130 via voltage supplement capacitors 90. The voltage supplement capacitors 90 connected to the gradation voltage supplement lines 91 are mounted on the source board 130. Accordingly, ceramic capacitors with capacities of as large as approximately 5 to 15 μF, more preferably, approximately 8 to 12 μF, can be used. The voltage supplement capacitors 90 connected to the connection nodes are charged in accordance with the potential across the connection nodes. Therefore, when the selector portion 55 simultaneously selects specific gradation voltages a number of times, so that the potential across the connection nodes that output the gradation voltages drops sharply, the connection nodes are provided with current supplement by the charged voltage supplement capacitors 90 connected to the gradation voltage supplement lines 91. Thus, the potential across the connection nodes can be inhibited from being reduced. Note that it is preferable to dispose approximately six to 13, even more preferably, approximately eight to 12, voltage supplement capacitors 90 on the source board 130. Accordingly, it is also preferable to form approximately six to 13, even more preferably, approximately eight to 12 gradation voltage supplement lines 91 on the source board 130 so as to be connected to the voltage supplement capacitors 90.

Figure 5:
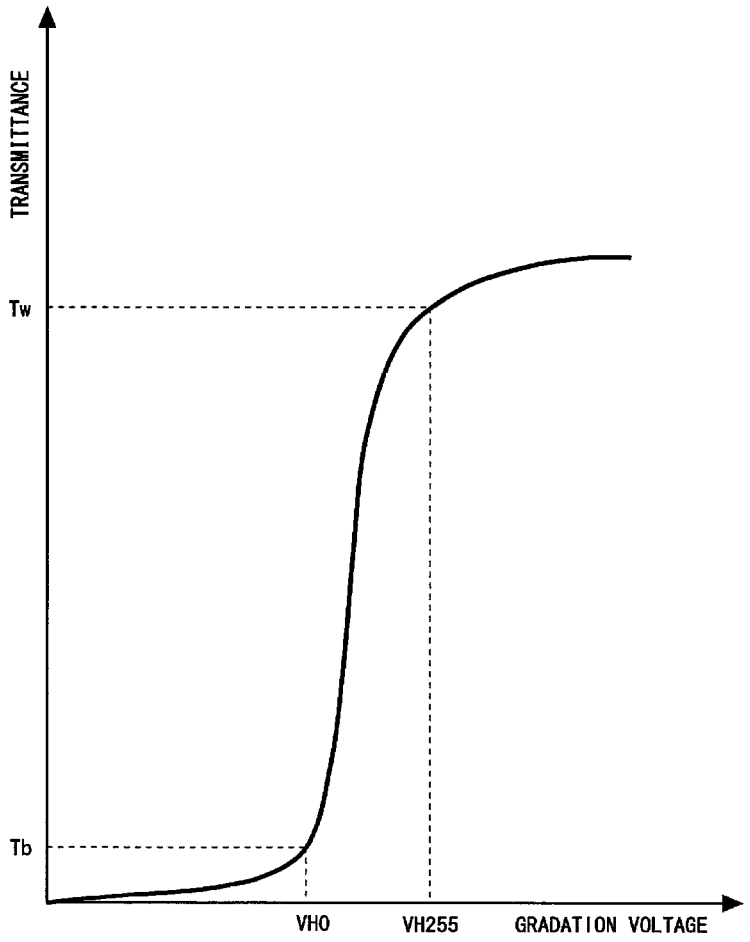
FIG. 5 is a graph showing a transmittance-voltage characteristic of a normally black liquid crystal panel.
Figure 6:
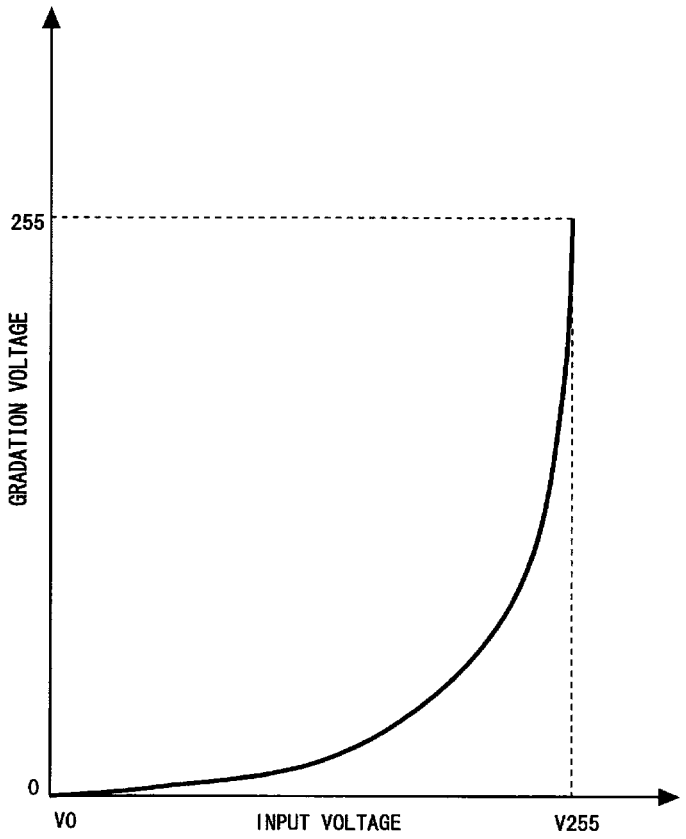
FIG. 6 is a graph showing the relationship between gradation value and input voltage, which is based on the transmittance-voltage characteristic shown in FIG. 5.

FIG. 5 is a graph showing a transmittance-voltage characteristic of a normally black liquid crystal panel. In FIG. 5, Tb is a transmittance where the normally black liquid crystal panel has a gradation value of 0, and Tw is a transmittance where the gradation value is 255. FIG. 6 is a graph showing the relationship between gradation value and input voltage, which is based on the transmittance-voltage characteristic shown in FIG. 5. As shown in FIG. 6, in a high transmittance range, i.e., a high gradation range, the inclination with respect to the input voltage is steep. Accordingly, if the gradation voltage decreases in the high gradation range, a video might be displayed with a gradation significantly different from a gradation with which the video should originally be displayed. Therefore, in the present embodiment, more gradation voltage supplement lines 91 are provided for the high gradation range, whereby a correction can be made such that a high-gradation video, which is susceptible to being displayed with a gradation lower than a gradation with which the video should originally be displayed when the same gradation voltages are simultaneously selected a number of times, is displayed with the original gradation.

Therefore, to inhibit the voltage of the analog video signal from decreasing due to a high current flowing when the same gradation voltages are simultaneously selected, for example, a gradation supplement voltage $Vc_1$ is applied to the connection node between the resistive elements $R_3$ and $R_4$, a gradation supplement voltage $Vc_2$ to the connection node between the resistive elements $R_5$ and $R_6$, a gradation supplement voltage $Vc_3$ to the connection node between the resistive elements $R_8$ and $R_9$, a gradation supplement voltage $Vc_4$ to the connection node between the resistive elements $R_{95}$ and $R_{96}$, a gradation supplement voltage $Vc_5$ to the connection node between the resistive elements $R_{159}$ and $R_{160}$, a gradation supplement voltage $Vc_6$ to the connection node between the resistive elements $R_{215}$ and $R_{216}$, a gradation supplement voltage $Vc_7$ to the connection node between the resistive elements $R_{227}$ and $R_{228}$, a gradation supplement voltage $Vc_8$ to the connection node between the resistive elements $R_{244}$ and $R_{245}$, a gradation supplement voltage $Vc_9$ to the connection node between the resistive elements $R_{247}$ and $R_{248}$, and a gradation supplement voltage $Vc_{10}$ to the connection node between the resistive elements $R_{251}$ and $R_{252}$. In this manner, most of the gradation voltage supplement lines 91 are connected to the connection nodes between the resistive elements $R_{215}$ to $R_{252}$. Note that this is an illustrative example and is not limiting.

Furthermore, the voltage supplement capacitor 90 is also referred to as the "first capacitor", the gradation voltage supplement line 91 is also referred to as the "first voltage line", the gradation reference voltage capacitor 95 is also referred to as the "second capacitor", and the gradation reference voltage line 96 is also referred to as the "second voltage line".

Effects

Figure 7:
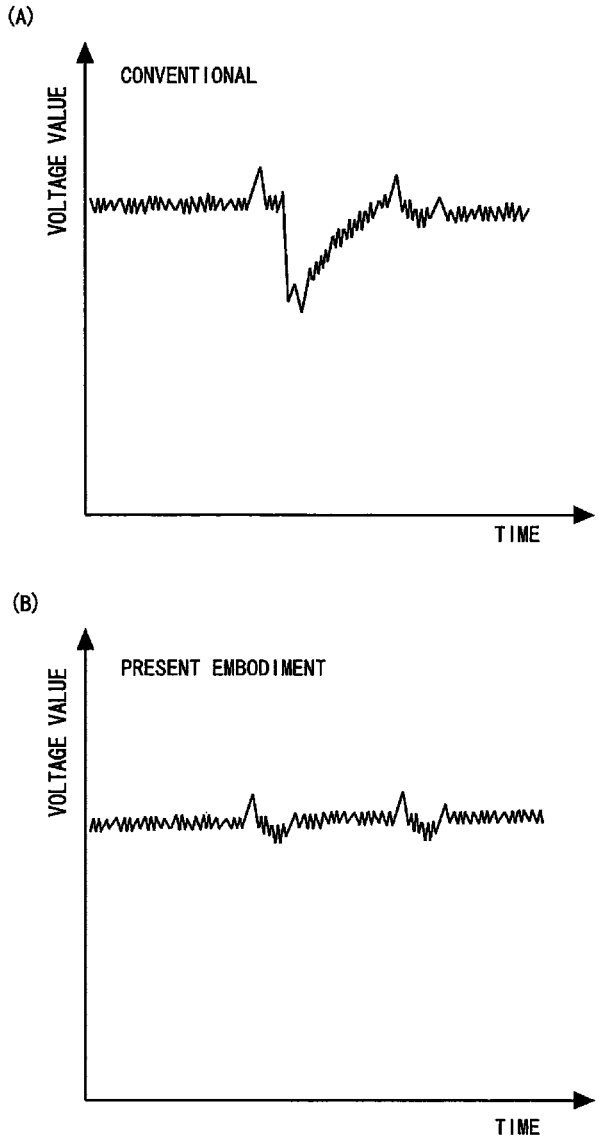
FIG. 7 provides graphs showing waveforms of output voltages derived from source drivers as shown in FIG. 3, on a horizontal line by horizontal line basis; more specifically.

FIG. 7 provides graphs showing waveforms of output voltages derived from source drivers 50, on a horizontal line by horizontal line basis; more specifically, FIG. 7(A) is a graph showing a waveform of an output voltage derived from a conventional source driver 50, on a horizontal line by horizontal line basis, and FIG. 7(B) is a graph showing a waveform of an output voltage derived from the source driver 50 included in the present embodiment, on a horizontal line by horizontal line basis. In the case of the liquid crystal display device 10, which displays a high-resolution video, the duration of driving each horizontal line is short. Accordingly, as for horizontal lines from which a number of output voltages of the same gradation value should simultaneously be provided, conventionally, when the output voltages sharply drop, it takes time until the original voltage value is recovered, as shown in FIG. 7(A). Moreover, such influence remains for the next horizontal line, and therefore the output voltages fluctuate significantly. However, in the case where the source driver 50 included in the present embodiment is used, even when the output voltages are provided under the same conditions as in the conventional case, the output voltages fluctuate only slightly, resulting in almost no voltage drop, and further, the original voltage value is recovered within a short period of time, leaving almost no influence on the next horizontal line, as shown in and as can be appreciated from FIG. 7(B).

Figure 8:
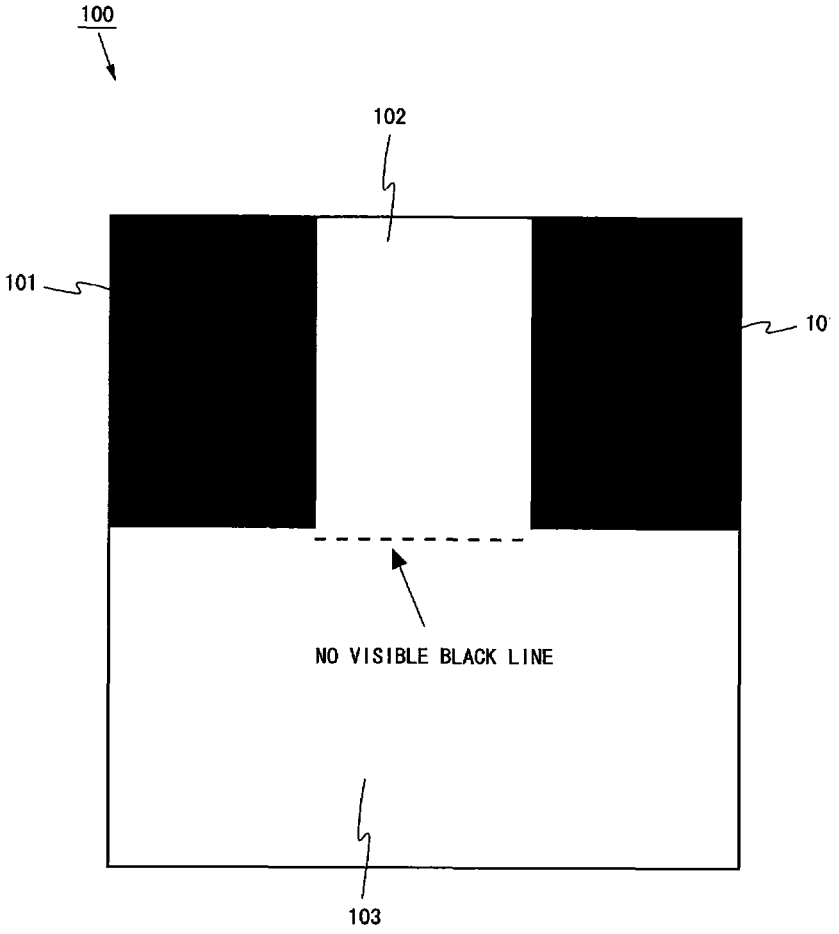
FIG. 8 is a diagram illustrating a video displayed on the liquid crystal panel using the source driver shown in FIG. 3.
Figure 9:
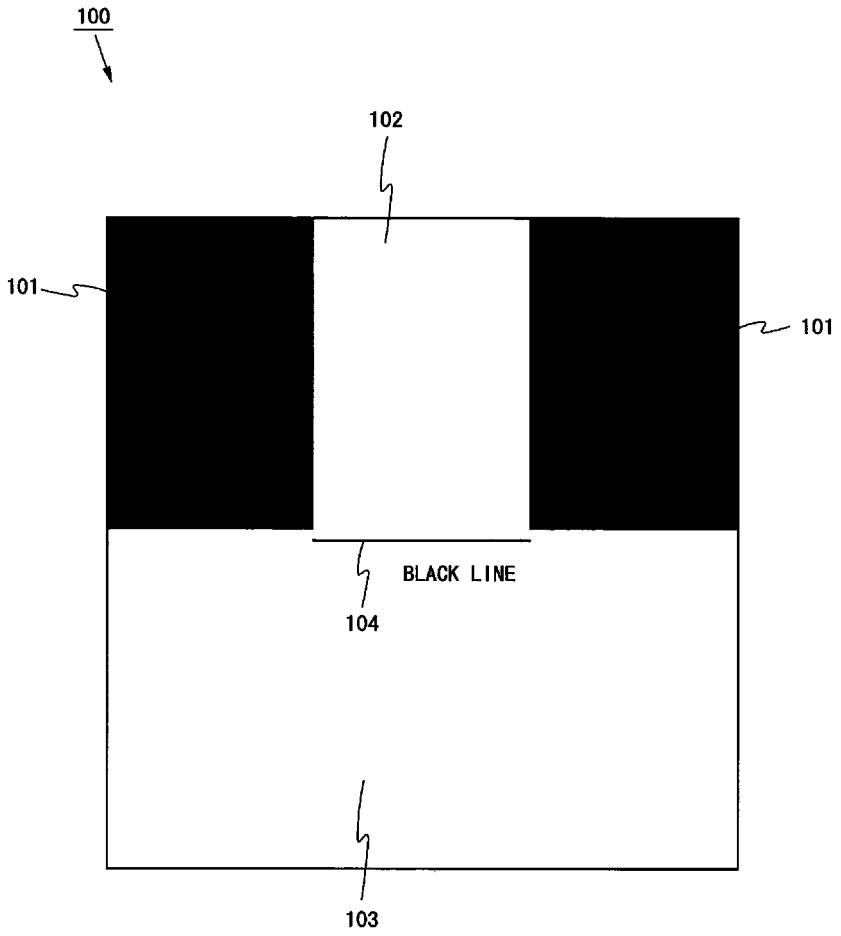
FIG. 9 is a diagram illustrating a video displayed on a display panel of a conventional liquid crystal display device where, due to voltage drop, gradation voltages have lower values than values with which the gradation voltages are provided.
Figure 10:
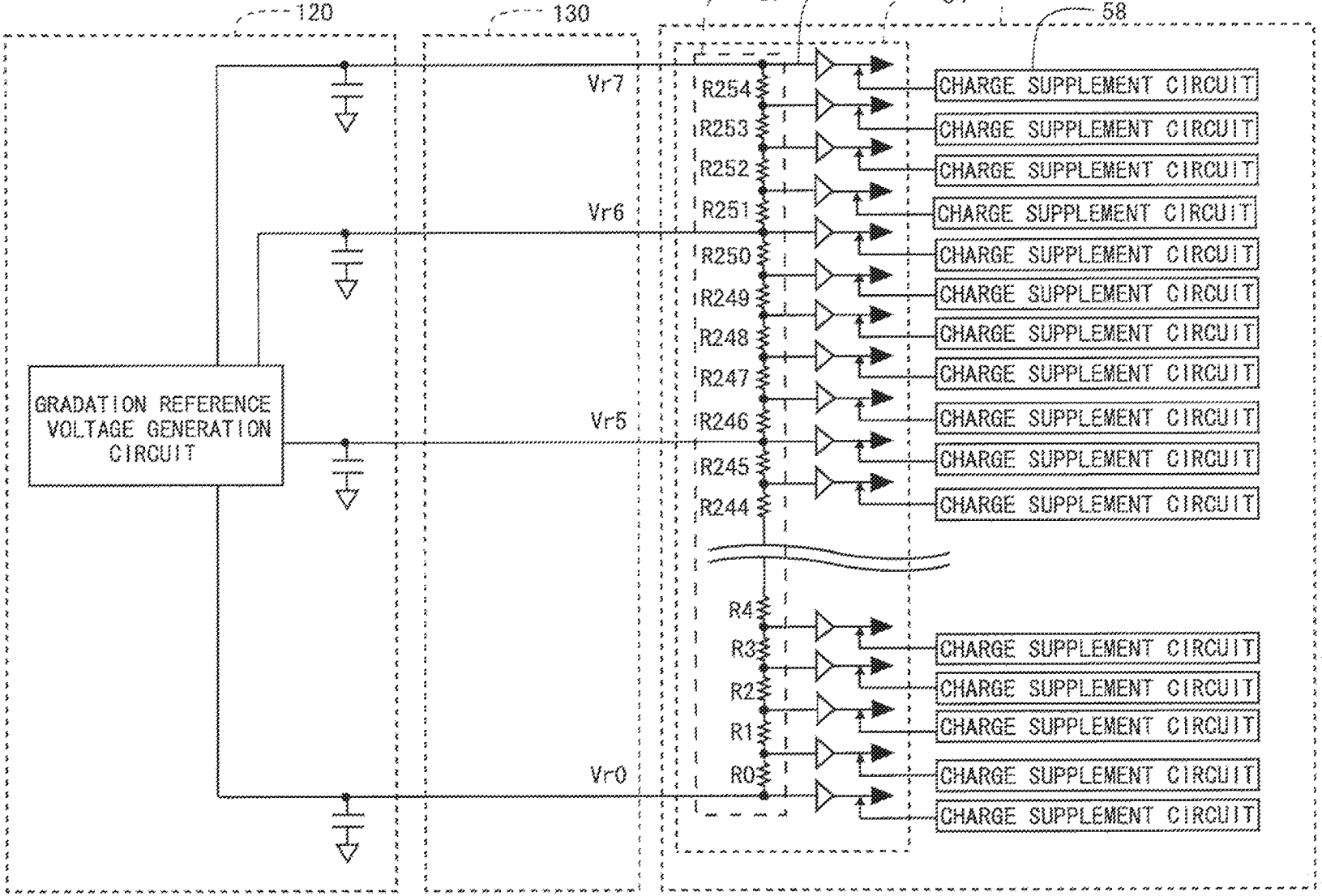
FIG. 10 (RELATED ART)
FIG. 10 is an equivalent circuit diagram of a gradation voltage generation portion included in a source driver of the conventional liquid crystal display device.

FIG. 8 is a diagram illustrating a video displayed on the liquid crystal panel 20 using the source drivers 50 in the present embodiment. As in the conventional case shown in FIG. 9, black areas 101 are displayed in upper left and upper right portions of a screen, and between these areas, there lies an area 102 displayed in white. Moreover, displayed across a lower portion of the screen is a white area 103. By using the source drivers 50 in a liquid crystal display device which displays such a video, it is rendered possible to significantly suppress gradation voltage drop even when a video displayed on a horizontal line changes from a combination of black and white to simply white.

In particular, when the liquid crystal panel 20 with a high-definition resolution called 4K or 8K is used, the number of gate lines is twice or four times as many as are used conventionally, and therefore, the duration of drive per horizontal line becomes shorter. However, even in this case, voltage drop can be significantly suppressed, whereby a video can be displayed with a high viewing quality.

This application claims priority to Japanese Patent Application No. 2016-187848, filed Sep. 27, 2016 and titled "DISPLAY DEVICE", the content of which is incorporated by reference herein.

DESCRIPTION OF THE REFERENCE CHARACTERS

10 liquid crystal display device
20 liquid crystal panel
30 display control circuit
40 gate driver (scanning signal line driver circuit)
50 source driver (video signal line driver circuit)
54 gradation voltage generation portion
55 selector portion
70 gradation reference voltage generation circuit
90 voltage supplement capacitor (first capacitor)
91 gradation voltage supplement line (first voltage line)
95 gradation reference voltage capacitor (second voltage line)
96 gradation reference voltage line (second voltage line)
120 control board
130 source board

The invention claimed is:

1. An active-matrix display device for providing gradation display of a video to be displayed, the active-matrix display device comprising:

a display panel including a plurality of scanning signal lines, a plurality of video signal lines crossing the scanning signal lines, and a plurality of display elements disposed in a matrix corresponding to respective intersections of the scanning signal lines and the video signal lines;

a scanning signal line driver circuit configured to selectively activate the scanning signal lines;

a gradation reference voltage generation circuit configured to output gradation reference voltages; and a video signal line driver circuit including a gradation voltage generation portion configured to generate gradation voltages based on the gradation reference voltages outputted by the gradation reference voltage generation circuit and a selector portion configured to select one of the gradation voltages based on an externally provided video signal, thereby generating an analog video signal, and apply the analog video signal to the video signal line, wherein the gradation voltage generation portion includes first voltage lines extending from output terminals for outputting the generated gradation voltages, the first voltage lines being grounded outside the video signal line driver circuit via first capacitors, wherein the gradation voltage generation portion includes a voltage ladder including a plurality of resistive elements connected in series, and the gradation voltage is a voltage obtained by subjecting a voltage derived from the gradation reference voltage generation circuit to resistive division by the resistive elements, and wherein the gradation reference voltage generation circuit provides the gradation reference voltages to terminals of resistive elements situated at opposite ends of the resistive elements connected in series in the voltage ladder and also to predetermined connection nodes between all the connection nodes of the resistive elements in series in the voltage ladder.

2. The active-matrix display device according to claim 1, wherein the first capacitor has a capacity of 5 to 15 μF.

3. The active-matrix display device according to claim 1, wherein the number of first capacitors is six to 13.

4. The active-matrix display device according to claim 1, comprising second voltage lines connecting the gradation reference voltage generation circuit and the connection nodes of the voltage ladder in order to apply the gradation reference voltages to the connection nodes, wherein the second voltage lines are connected to grounded second capacitors outside the video signal line driver circuit.

* * * * *